United States Patent [19]

Hinton et al.

[11] 3,966,591

[45] June 29, 1976

[54] FILLING BOBBIN INSPECTION DEVICE

[75] Inventors: Charles V. Hinton; Kenneth W. Troutman; Richard Ferguson, all of Charlotte, N.C.

[73] Assignee: The Terrell Machine Company, Charlotte, N.C.

[22] Filed: May 23, 1975

[21] Appl. No.: 580,423

[52] U.S. Cl. ..... 209/73; 209/90

[51] Int. Cl.[2] ..... B07C 1/10

[58] Field of Search ..... 209/90, 72, 73, 74, 209/82, 88, 76–78; 28/19, 20

[56] References Cited

UNITED STATES PATENTS

| | | | |
|---|---|---|---|
| 3,305,087 | 2/1967 | Lucker | 209/90 X |
| 3,307,694 | 3/1967 | Selwood et al. | 209/90 X |
| 3,647,065 | 3/1972 | Powell | 209/88 R |

*Primary Examiner*—Allen N. Knowles
*Attorney, Agent, or Firm*—Richards, Shefte & Pinckney

[57] ABSTRACT

A filling bobbin inspection device is provided for checking the completeness of a bobbin stripping operation. Magnet means maintain the bobbins received from the stripping operation suspended at the butts thereof while feeler means checks each bobbin received and acts as a stationary cam upon detecting an incompletely stripped bobbin to cause all such bobbins to be dropped selectively from the magnet means suspension.

11 Claims, 5 Drawing Figures

FILLING BOBBIN INSPECTION DEVICE

BACKGROUND OF THE INVENTION

Spent filling bobbins when ejected from a loom of the automatic filling replenishment type have residual yarn windings, commonly referred to as a "bunch," remaining on the bobbin barrel adjacent its base or butt which must be removed or stripped before the bobbin can be reused. While highly effective equipment for stripping the spent bobbins has been developed, a certain percentage remain incompletely stripped after passing through the stripping operation and it is desirable to detect and separate the incompletely stripped bobbins automatically for reprocessing. Inspection arrangements for accomplishing this purpose have heretofore been provided as seen in U.S. Pat. Nos. 2,868,372, 2,634,489, and 1,136,051. Such prior art arrangements, however, have been undesirably complicated, and the inspection device presently provided incorporates an advantageously simplified arrangement that operates with excellent effectiveness.

SUMMARY OF THE INVENTION

The inspection device of the present invention operates in combination with means for feeding a series of spent filling bobbins, that have been subjected to stripping action, along a given path while suspended from the butts thereof, and comprises an elongated magnet means together with a bobbin feeler means. The elongated magnet means is aligned at one side of the given path along which the bobbins are fed for receiving them serially and maintaining the suspension thereof through attraction at the butt rings while feeding travel continues. The feeler means is arranged adjacent the end of the magnet means at which the bobbins are received and is disposed to extend laterally and angularly into the feeding path at a normally biased position for consecutive contact with the barrels of the bobbins being fed at the location from which the residual yarn bunches must be stripped. The operating arrangement of the feeler means is such that it is pivotally displaceable from its normal position in the plane of the longitudinal axis of each suspended bobbin that is completely stripped to allow continuing travel of such bobbins along the magnet means, but is held against such pivoting upon engaging a remaining bunch on any incompletely stripped bobbin and is thereby caused to act at its normal position as a stationary cam for forcing such bobbins to be dropped from the feeding series.

The structural arrangement and mode of operation of the device is described in fuller detail below in connection with the accompanying drawings that correspond to the following listing.

DETAILED DESCRIPTION OF THE INVENTION

Figure 1:
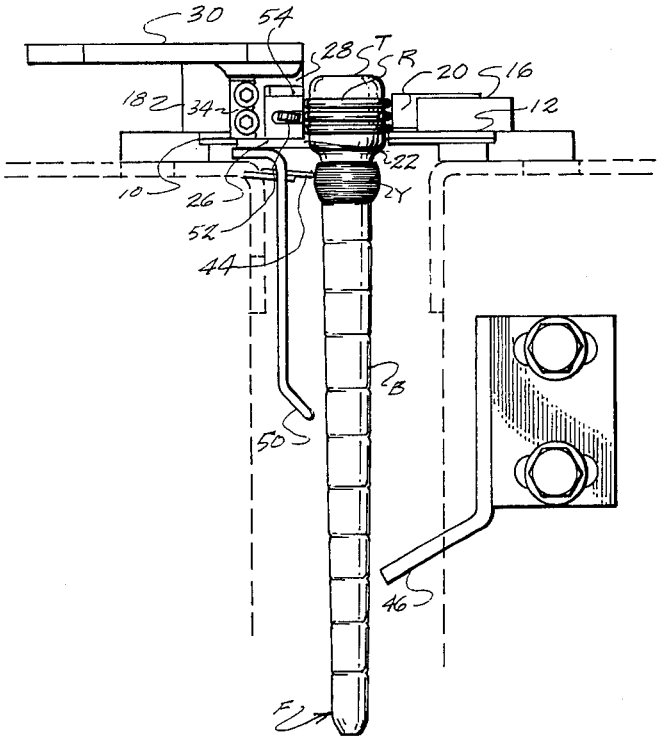
FIG. 1 is an end elevation of an inspection device embodying the present invention as seen from the end toward which the bobbin series is fed.
Figure 2:
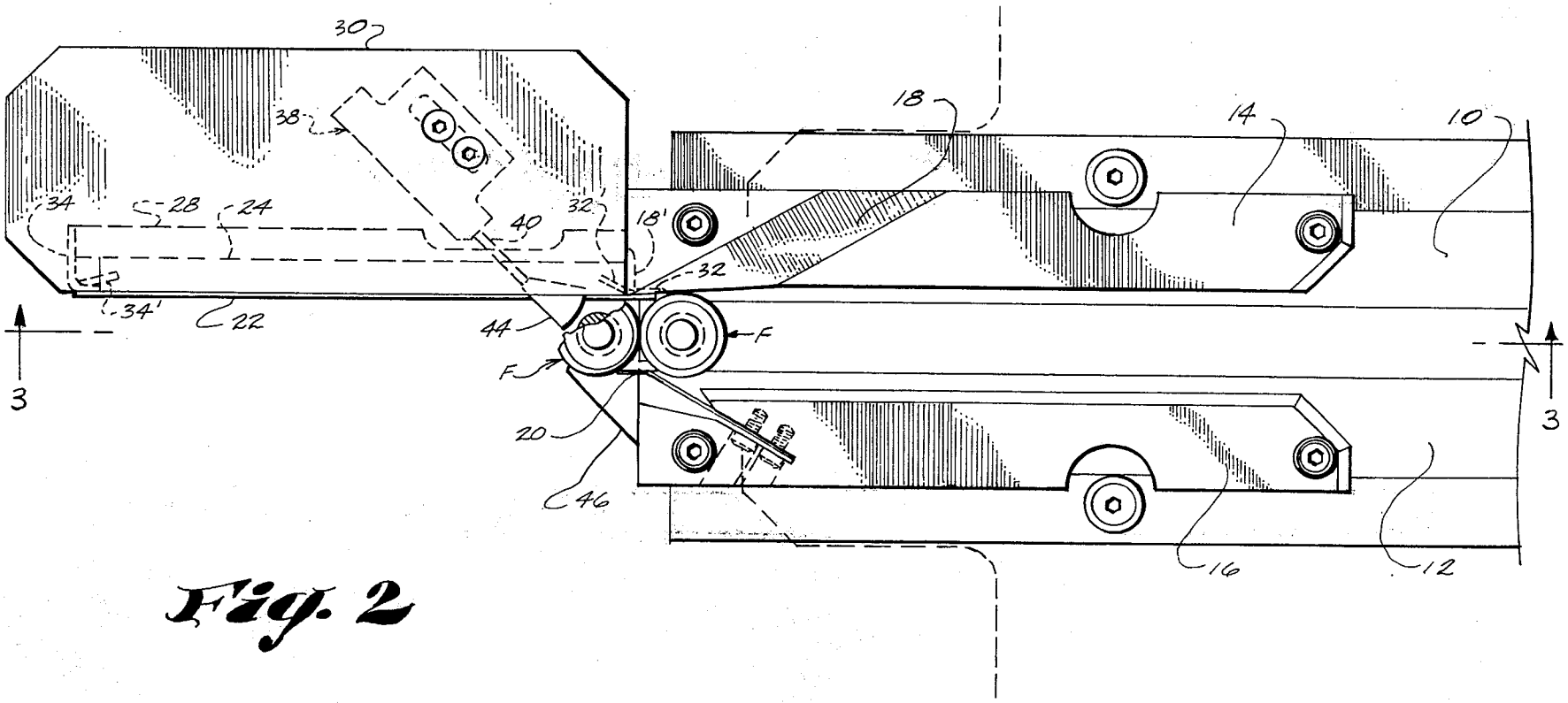
FIG. 2 is a plan view corresponding generally to FIG. 1.

In the illustrated embodiment, typical filling bobbins F are shown in FIGS. 1 and 2 to indicate the manner in which they are presented for inspection according to the present invention. For this purpose, the bobbins F are suspended from their butts T between spaced rails 10 and 12 (see FIG. 2). These rails 10 and 12 will normally be those provided at the discharge end of bobbin stripping equipment, and they define a given path along which the bobbins F are fed in a serial stream after being subjected to stripping action by the stripping equipment.

In particular, the bobbins F ride the spaced rails 10 and 12 at what is normally the top bobbin butt ring R but which is the lowermost one in the suspended condition of the feeding bobbins. It will be understood that the butt rings R are those conventionally provided on filling bobbins for locating them in loom shuttles. Adjacent their discharge ends both bobbin supporting rails 10 and 12 have plate members 14 and 16 superimposed thereon, although set back sufficiently to allow free bobbin feeding travel. At the discharge end, the plate member 14 on rail 10 is fitted with a support block 18 having a vertical profile that angles inwardly to provide a smooth, non-jamming surface to protect the end of magnet means 24 and prevent bobbins F or accompanying waste from abutting the end of magnet means 24. The other plate member 16 on rail 12 serves as a bracket for a leaf spring 20 that is disposed to bear at the opposite side of the butt rings R to insure that the feeding bobbins F come in contact with magnet means 24.

Both support block 18 and leaf spring 20 extend enough beyond the respective ends of rails 10 and 12 to maintain the suspension of bobbins F while the lowermost butt rings R ride onto an extension 22 of rail 10 and come within the attractive influence of elongated magnet means 24 aligned with support block 18 at the adjacent side of bobbins F. The magnet means 24, which is preferably of the permanent magnet sort, has a channel form in cross-section with channel legs spaced in correspondence with the spacing of the topmost and lowermost butt rings R of the suspended bobbins F (see FIG. 1).

Figure 3:
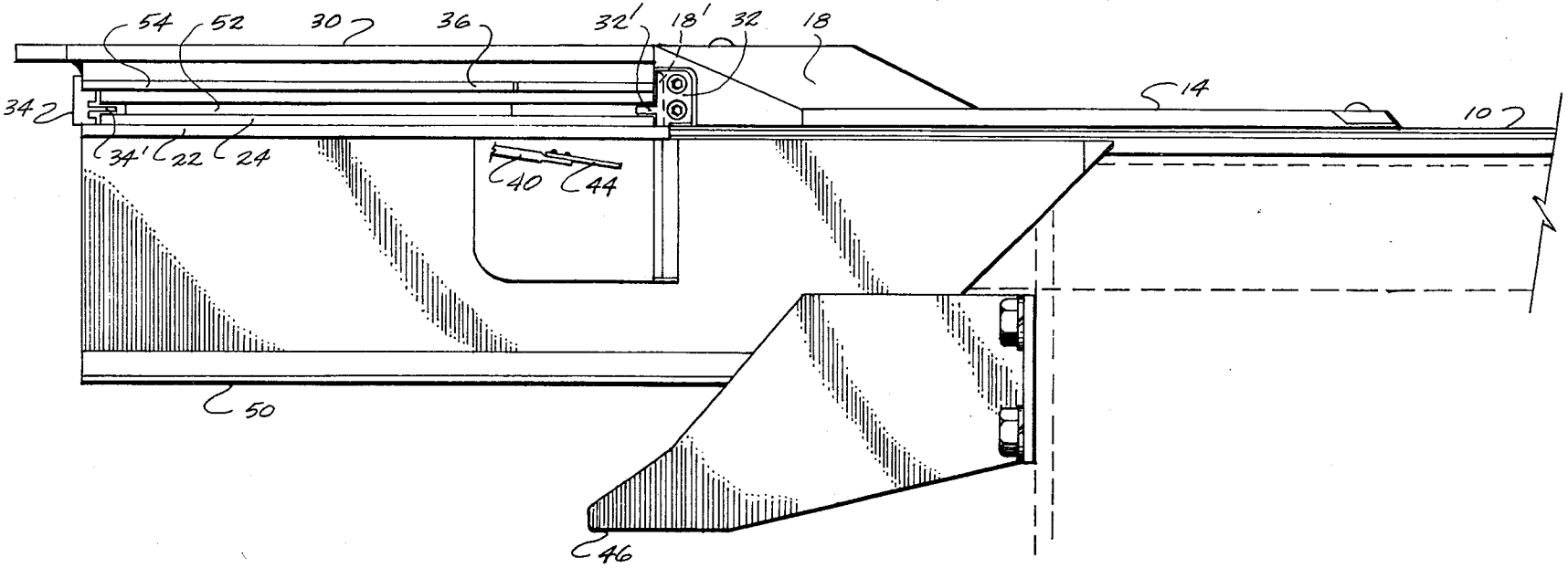
FIG. 3 is a vertical section taken substantially at the line 3—3 in FIG. 2.

The rail extension 22 is formed by a flanged edge of a plate member 26 by which the magnet means 24 is confined and that is supported in turn on an L-shaped bracket bar 28 suspended from a top plate 30 which, together with bar 28, is secured to support block 18 by welding or the like. The flanged edge of rail extension 22 must be of width less than the overhang of lowermost bobbin butt ring R beyond the body of butt T, and said edge must be pulled up tight against the working surface of magnet means 24 so that the topmost and lowermost rings R will not be held from contact with the said working surface by said flanged edge. The magnet means 24 backs against bracket bar 28 and is held in place by end clamps 32 and 34. The right end clamp 32, as seen in FIG. 3, has a flat body portion and is mounted at a recessed portion at the vertical face of support block 18 so as to be disposed flush thereat, and has an angled finger portion 32' extending within the channel of magnet means 24 for clamping purposes. Left end clamp 34 is mounted at the adjacent end of bracket bar 28 (see FIG. 1) and extends forwardly to an angled portion aligned flush with the active faces of the magnet means channel legs, while also having an angled finger portion 34' extending therebetween in clamping relation. Both end clamps 32 and 34, as well as the magnet means confining plate 26 are formed of a non-magnetic material, such as stainless steel, and the end face of support block 18 is further recessed (as indicated at 18' in FIGS. 2 and 3) to provide an air space at the adjacent end of magnet means 24, while a non-magnetic spacer 36, suitably of Nylon, is installed on top of an initial right-hand portion of magnet means 24 beneath the overlying portion of bracket bar 28, so as to provide adequate magnetic holding power at this portion of magnet means 24 to maintain the suspension of the feeding bobbins F as they are being inspected.

Figure 4:
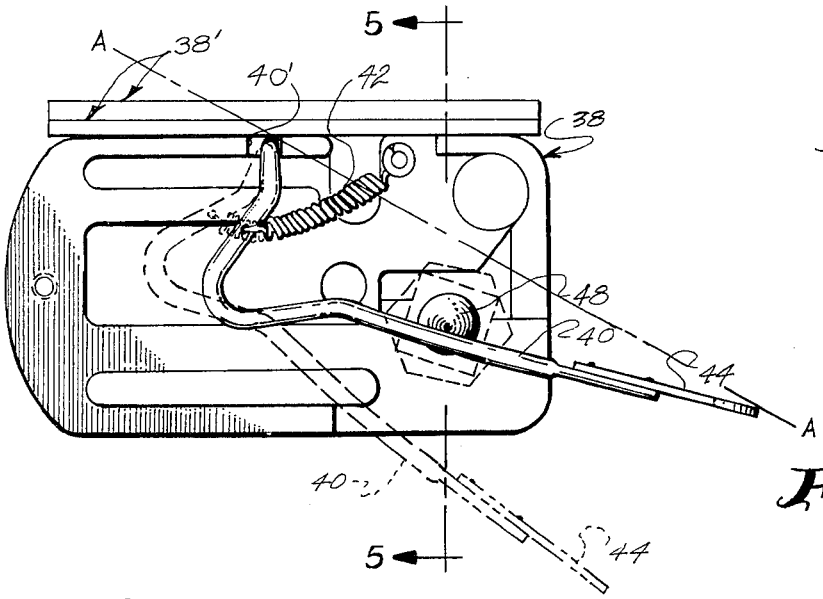
FIG. 4 is a detail in side elevation illustrating the arrangement of the feeler means.

Inspection of the feeding bobbins F is accomplished by a feeler means 38 comprising a casing mounted beneath the top plate 30 from which a feeler arm 40 biased by a spring 42 at a normal position extends laterally and angularly into the feeding path of the bobbins F (compare FIGS. 2 and 4). A tip member 44 is mounted at the extending end of feeler arm 40 that is adapted to slide along the barrel B of a completely stripped bobbin F but to bite into the remaining yarn bunch Y on any incompletely stripped bobbin F. In the illustrated embodiment, the tip member 44 takes the form of a relatively thin plate as in the previously noted prior U.S. Pat. No. 2,868,372, although it may alternatively have a block form with a serrated feeler face if the bobbins being inspected have circumferential grooves in their barrels sufficiently close to the butts to impede longitudinal sliding of a plate form of tip member 44. Otherwise the plate form of tip member 44 is preferred because it bites into a remaining yarn bunch Y more readily.

In any event, sliding of the feeler tip member 44 along the barrel B of a completely stripped bobbin F is allowed because the other end of feeler arm 40 is pivotally held at a notch 40' in the casing of feeler means 38 (see FIG. 4) so as to pivot towards the illustrated broken line position substantially in the plane of the longitudinal axis of a bobbin F being inspected and thereby allow a completely stripped bobbin F to pass while still suspended from the magnet means 24. If, however, the feeler tip member 44 finds a remaining yarn bunch Y on the bobbin F being inspected, it will bite into this bunch and thereupon be held against pivoting so as to act as a stationary cam and force the bobbin butt rings R out of the grasp of magnet means 24 with the result of selectively dropping the involved bobbin F from the feeding series. Such selective dropping is aided by a bobbin tip guide 46 that is mounted in offset opposing relation with respect to feeler means 38 to serve as a fulcrum whenever feeler tip member 44 is caused to act as a stationary cam.

Figure 5:
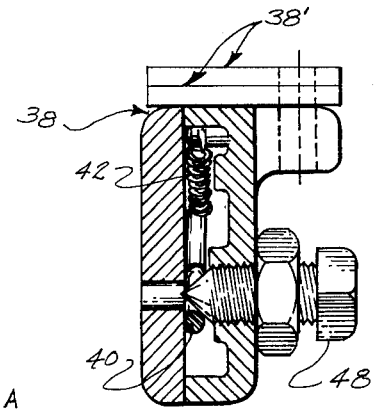
FIG. 5 is a sectional detail taken substantially at the line 5—5 in FIG. 4.

In order to set the normal extending position of feeler arm 40 and tip member 44 as close up under the butt as practicable for complete feeling coverage of the bunch area along the barrel of a supposedly stripped bobbin F, the casing of feeler means 38 is fitted with a cone-pointed set screw 48 that is adjustable above feeler arm 40 to determine its normal position against the bias of spring 42 (compare FIGS. 4 and 5). Since the sensitivity of the feeler tip to yarn windings (as well as to rough spots on the bobbin barrel) is inversely related to the angle formed with the horizontal by a line A—A passing through the notch 40' and the contacting edge of feeler tip member 44, shims or spacers 38' are customarily added between the casing of feeler means 38 and the top plate 30—as many as one to four shims each ⅛ inch thick may be added for more and more sensitivity. Also, in order to guard against unintended loss of bobbin suspension along the magnet means 24, a bobbin barrel guide 50 is mounted to reach parallelly below the magnet means 24 to serve as a stop preventing any feeding bobbin F from pivoting about its support on rail extension 22 farther than will allow the force of magnet means 24 to right such a bobbin again.

Once an inspected bobbin F has been found completely stripped and been allowed to pass feeler means 38, it is desirable that continuing travel of the stripped bobbins along magnet means 24 not be unduly impeded, and for this purpose the magnet means attractive force is weakened beyond feeler means 38 by installing insert strips 52 and 54 of magnetic material with the channel of and on top of magnet means 24 (see FIG. 3). When the stripped bobbins F reach the terminal end of magnet means 24 they pass over the flush portion of non-magnetic end clamp 34 so as to be freed from the influence of magnet means 24 and drop away for separate collection.

The arrangement of feeler means 38 allows sequential inspection of the feeding bobbins F in a particularly consistent and dependable manner once the tip member 44 is set properly for this purpose. Such setting involves fixing the extending normal position of tip member 44, from the feeler means mounting on top plate 30, so that the bobbins F are not contacted for inspection until they clear the end of rail 12 at the opposite side, but so that inspection contact is established soon enough to bring tip guide 46 into play for aid in dropping an incompletely stripped bobbin, while employing such aid close enough to the end of tip guide 46 so that a dropped bobbin will fall clear of this end. Also, the cone-pointed adjustment screw 48 installed in the casing of feeler means 38 must be used to set the normal position of tip member 44 vertically to assure that it will start its feeling motion immediately under the butt in order to feel a maximum distance along the barrel of a supposedly stripped bobbin F in allowing it to pass or in camming it off the magnet means 24.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. A filling bobbin inspecting device for checking the completeness of a bobbin stripping operation comprising, in combination with means for feeding a series of spent filling bobbins that have been subjected to stripping action along a given path while suspended from the butts thereof, an elongated magnet means aligned at one side of said given path for receiving said bobbins serially and maintaining the suspension thereof through attraction at the butt rings while feeding travel continues, and feeler means extending laterally and angularly into said given feeding path at a normally biased position from which it is pivotally displaceable in the plane of the longitudinal axis of each suspended bobbin that is completely stripped to allow continuing travel of such bobbins along said magnet means, but at which position said feeler means is held by a remaining bunch on any incompletely stripped bobbin and thereby caused to act as a stationary cam for forcing such bobbins to be dropped from said series.

2. The combination defined in claim 1 in which said magnet means is an elongated channel magnet having channel legs spaced in correspondence with the spacing of the top and bottom butt rings of a filling bobbin.

3. The combination defined in claim 2 in which a leaf spring is disposed to engage the bobbin butts at the side opposite said magnet means for guiding the same into contact therewith as the same are received by said magnet means.

4. The combination defined in claim 2 in which said magnet means is confined by a plate and held in place by end clamps all of non-magnetic material.

5. The combination defined in claim 4 in which said supporting plate is additionally formed to provide a rail on which the top butt ring of said bobbins rides while said bobbins are suspended from said magnet means.

6. The combination defined in claim 5 in which a bobbin barrel guide is mounted to reach parallelly below said magnet means to prevent unintended loss of bobbin suspension at said magnet means.

7. The combination defined in claim 5 in which bars of magnetic material are disposed within the channel of said magnet means and along the top thereof beyond said feeler means for weakening the attractive force of the magnet means thereat so that continuing travel of stripped bobbins is not unduly impeded.

8. The combination defined in claim 1 in which said feeler means comprises a feeler arm biased at a normal position extending into said given feeding path and having a tip member mounted at its extending end adapted to slide along the barrel of a completely stripped bobbin but to bite into the remaining bunch on any incompletely stripped bobbin, and said feeler arm being pivotally held at its other end.

9. The combination defined in claim 8 in which an adjustable abutment means is provided to set the normal position of said feeler arm against the bias thereon.

10. The combination defined in claim 1 in which a bobbin tip guide is mounted in offset opposing relation with respect to said feeler means to serve as a fulcrum for aiding in dropping of a bobbin from said series when said feeler means acts as a stationary cam.

11. A filling bobbin inspecting device for checking the completeness of a bobbin stripping operation comprising, in combination with means for feeding a series of spent filling bobbins that have been subjected to stripping action along a given path while suspended from the butts thereof, an elongated rail means aligned at one side of said given path for receiving said bobbins serially and an elongated discretely yieldable biasing means maintaining the suspension thereof by holding the butts thereof against said rail means while feeding travel continues, and feeler means extending laterally and angularly into said given feeding path at a normally biased position from which it is pivotally displaceable in the plane of the longitudinal axis of each suspended bobbin that is completely stripped to allow continuing travel of such bobbins along said rail means, but at which position said feeler means is held by a remaining bunch on any incompletely stripped bobbin and thereby caused to act as a stationary cam for forcing such bobbins to be dropped from said series.

* * * * *